US009336758B1

(12) United States Patent
Takegawa

(10) Patent No.: US 9,336,758 B1
(45) Date of Patent: May 10, 2016

(54) DRUM HAVING INTERCHANGEABLE DRUM SHELL SEGMENTS

(71) Applicant: Pearl Musical Instrument Co., Chiba (JP)

(72) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 14/934,186

(22) Filed: Nov. 6, 2015

Related U.S. Application Data

(60) Provisional application No. 62/081,331, filed on Nov. 18, 2014.

(51) Int. Cl.
*G10D 13/02* (2006.01)

(52) U.S. Cl.
CPC ..... *G10D 13/023* (2013.01); *G10D 13/02* (2013.01)

(58) Field of Classification Search
CPC ..... G10D 13/023; G10D 13/02
See application file for complete search history.

(56) References Cited

U.S. PATENT DOCUMENTS

| | | | | | |
|---|---|---|---|---|---|
| 230,829 | A * | 8/1880 | Shear et al. | F16L 9/22 | 138/157 |
| 667,953 | A * | 2/1901 | Ross | B65D 9/04 | 138/157 |
| 700,567 | A * | 5/1902 | Schwab | B27H 3/02 | 147/25 |
| 1,768,438 | A * | 6/1930 | Clark | G10D 13/028 | 84/412 |
| 3,329,174 | A * | 7/1967 | Pfeil | B65D 25/14 | 138/141 |
| 3,667,639 | A * | 6/1972 | Pfeil | B65D 9/04 | 217/4 |
| 3,911,779 | A | 10/1975 | Della-Porta | | |
| 4,060,019 | A | 11/1977 | Cordes | | |
| 4,300,437 | A * | 11/1981 | Hinger | G10D 13/028 | 84/411 R |
| 4,993,304 | A | 2/1991 | Lovelet | | |
| 5,301,591 | A * | 4/1994 | Greenberg | G10D 13/028 | 84/411 R |
| 5,377,576 | A * | 1/1995 | Good | G10D 13/028 | 84/411 R |
| 5,981,858 | A * | 11/1999 | Jeng | G10D 13/028 | 84/104 |
| 6,242,679 | B1 | 6/2001 | Carlson | | |
| 6,462,262 | B2 * | 10/2002 | Hagiwara | G10D 13/028 | 84/411 R |
| 6,525,250 | B2 * | 2/2003 | Goods | G10D 13/02 | 84/411 A |
| 7,361,823 | B2 | 4/2008 | Rush | | |
| 7,718,876 | B1 | 5/2010 | Good | | |
| 7,781,659 | B2 * | 8/2010 | Liao | G10D 13/02 | 84/411 R |
| 7,781,660 | B2 * | 8/2010 | Paterson | G10D 13/02 | 84/411 R |
| 7,888,574 | B1 * | 2/2011 | Acoutin | G10D 13/02 | 84/411 R |
| 8,791,347 | B1 * | 7/2014 | Christian | G10D 13/028 | 84/411 R |

OTHER PUBLICATIONS

"Craviotto Stacked Solid Drums & Drum Sets", 2013, Retrieved from the Internet: < URL: http://www.craviottodrums.com/drums.php?p=solids>, retrieved on Nov. 4, 2015.

* cited by examiner

*Primary Examiner* — Robert W Horn
(74) *Attorney, Agent, or Firm* — Manelli Selter PLLC; Edward J. Stemberger

(57) ABSTRACT

A drum includes a drum shell having a first drum shell segment and a separate, second drum shell segment. The drum shell segments each including a hollow cylindrical member having a rim, a protrusion formed in an upper surface of the rim, and an annular groove formed in a lower surface of the rim. The protrusion of the first drum shell segment is received in the groove of the second drum shell segment so that the drum shell segments are in axially stacked relation. A first hoop mounts a first drum skin to the drum shell. Tensioning structure is constructed and arranged to removably secure the drum shell to the first hoop.

25 Claims, 5 Drawing Sheets

DRUM HAVING INTERCHANGEABLE DRUM SHELL SEGMENTS

FIELD

The present invention is directed to a drum shell for a drum such as a snare drum, and more particularly, to an improved drum shell that is interchangeable to modify the resonance and sound of the drum.

BACKGROUND

A drum typically includes a cylindrical drum shell having a hollow chamber. A drum skin is mounted to one end of the drum shell using a skin support. A tensioning device coupled between the drum shell and the skin support adjusts the tension of the drum skin which affects the resonance and the resulting sound.

A drum has various sound characteristics including pitch, loudness or audible intensity, and timbre (e.g., tone). These characteristics can be modified in various ways. For example, the tensioning device can be adjusted to make the tension of the drum skin tighter or looser. However, due to the tuning necessary to achieve the appropriate pitch, this type of adjustment is typically made before a performance and is difficult to modify during a performance.

Alternatively, a sound characteristic of a drum can be modified by changing the material from which the drum shell is made. For example, the drum shell can be manufactured from metal, wood, synthetic composites, and/or a combination thereof. This type of modification can be performed at the time the drum shell is manufactured.

Therefore, a need exists for a drum shell having interchangeable drum shell segments that improves upon prior interchangeable drum shells and solves the problems inherent in known interchangeable drum shells.

SUMMARY

An aspect of the invention provides a drum having a drum shell including a first drum shell segment and at least a separate, second drum shell segment. The first drum shell segment and the second drum shell segment each comprises a hollow cylindrical member having a rim, a protrusion formed in an upper surface of the rim, and an annular groove formed in a lower surface of the rim that opposes the upper surface. The protrusion of one of the drum shell segments is received in the groove of the other of the drum shell segments so that the first and second drum shell segments are in axially stacked relation. A first hoop mounts a first drum skin to the drum shell. Tensioning structure is constructed and arranged to removably secure the drum shell to the first hoop.

In accordance with another aspect of an embodiment, a drum shell includes at least a first drum shell segment comprising a hollow cylindrical member having a rim, a protrusion formed in an upper surface of the rim, and an annular groove formed in a lower surface of the rim that opposes the upper surface.

Other aspects of the invention, including apparatus, articles, methods, systems, assemblies, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description, serve to explain the principles of the invention. In such drawings.

DETAILED DESCRIPTION OF EXAMPLE EMBODIMENTS

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
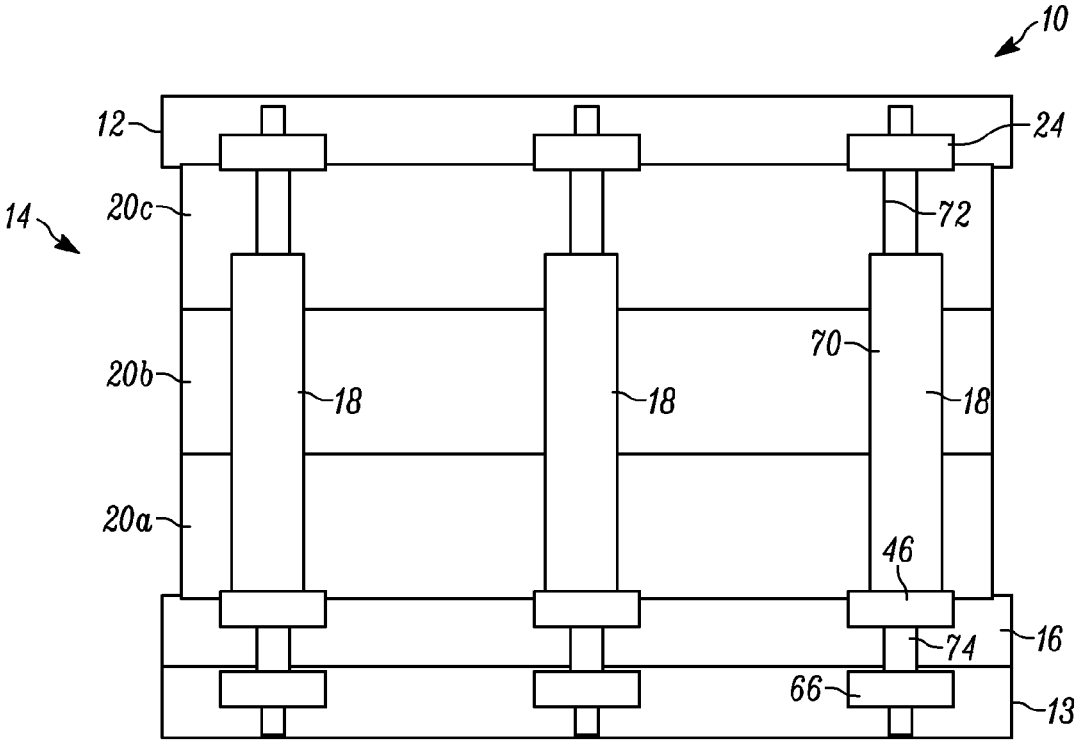
FIG. 1 is a side elevational view of a drum according to an exemplary embodiment of the present disclosure.

FIG. 1 illustrates a drum 10 according to an exemplary embodiment of the present invention. Drum 10 includes a first hoop 12, a second hoop 13, a drum shell, generally indicated at 14, tensioning structure including a chassis support 16, and a plurality of tensioning devices 18.

Figure 2:
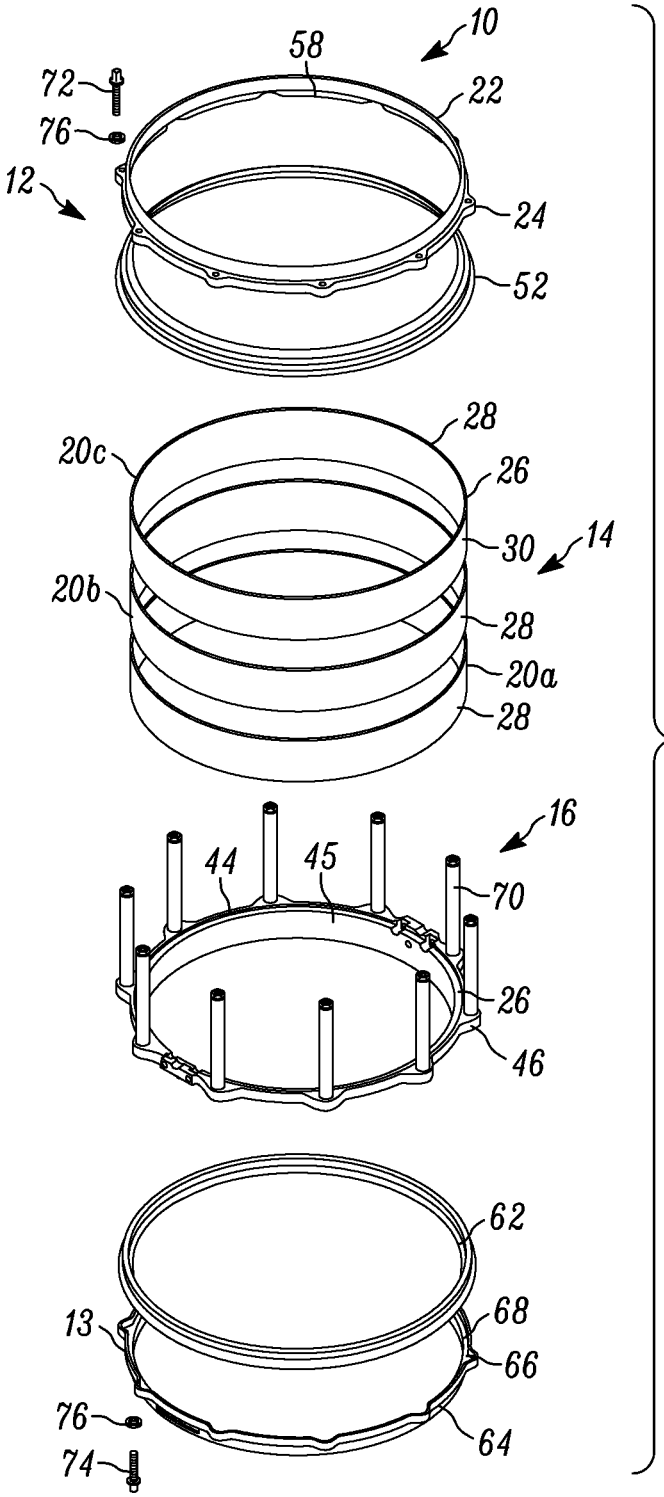
FIG. 2 is an exploded perspective view of a drum according to an exemplary embodiment of the present disclosure.
Figure 3:
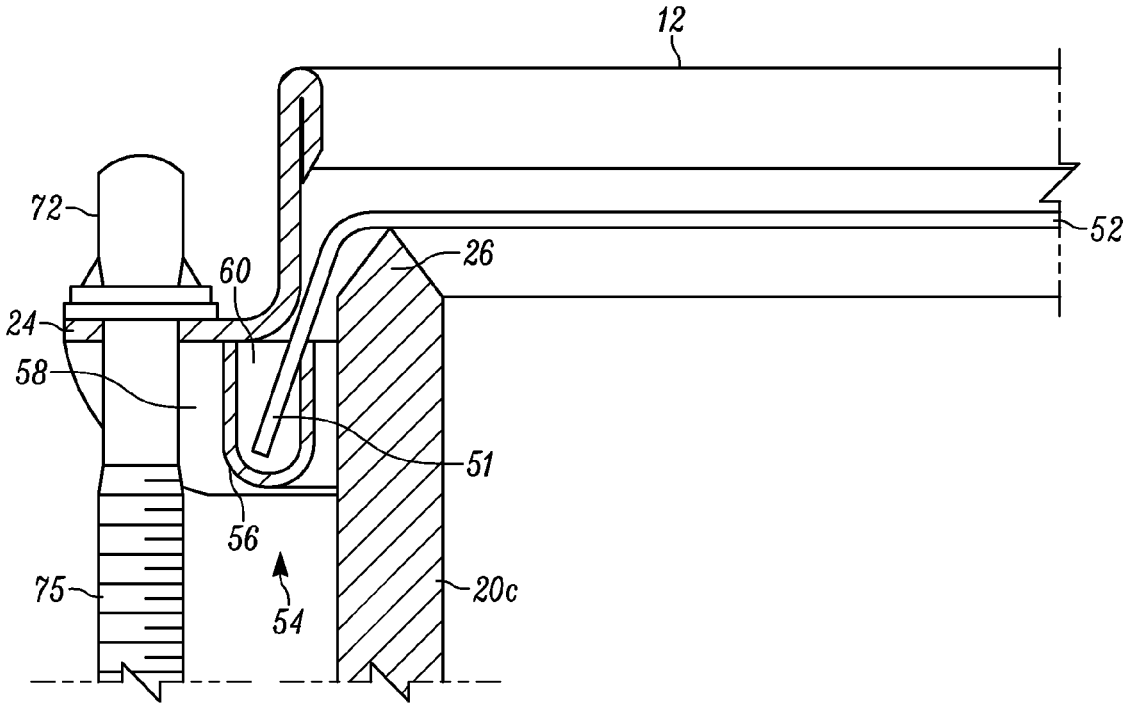
FIG. 3 is an enlarged cross-sectional view of a portion of a drum according to an exemplary embodiment of the present disclosure.

As shown in FIG. 2, the first hoop 12 is configured to mount a first drum skin or drumhead 52 to the drum 10. The first hoop 12 includes a ring member 22 with a plurality of flanges 24 extending from an outer surface of the ring member 22. In an exemplary embodiment, the flanges 24 are equally disposed around the circumference of the ring member 22. As best illustrated in FIG. 3, a first drum skin receiving structure, generally indicated at 54, is formed on an inner surface of the first hoop 12. The first drum skin receiving structure 54 is configured to receive and secure a peripheral end 51 of the first drum skin 52 with respect to the drum shell 14. For example, the first drum skin receiving structure 54 can include an annular recess 56 formed in a flange 58 that extends from the inner surface of the first hoop 12. In an exemplary embodiment, as illustrated in FIG. 3, the peripheral annular end 51 of the first drum skin 52 can be secured in the recess 56 using an adhesive 60. However, one of ordinary skill in the art would appreciate that no additional mounting structure is necessary. As illustrated in FIG. 3, a portion of the first drum skin 52 can be disposed between the first hoop 12 and a drum shell segment 20*c* of the drum shell 14.

The second hoop 13 is configured to mount a second drum skin 62 to the drum 10. For example, as illustrated in FIG. 2, the second hoop 13 can be mounted to the chassis support 16. The second hoop 13 includes a ring member 64 and a plurality of flanges 66 extending from an outer surface of the ring member 64 of the second hoop 13. In an exemplary embodiment, the flanges 66 are equally disposed around the circumference of the ring member 64. As best illustrated in FIG. 2, a second drum skin receiving structure 68 is formed on an inner surface of the second hoop 13. The second drum skin receiving structure 68 is configured to receive the second drum skin 62 in the similar manner discussed above with regard to the first drum skin receiving structure 54.

A drum shell 14 includes a plurality of drum shell segments 20*a*, 20*b*, 20*c*, with each shell having the same outer diameter.

However, drum shell 14 can include any number of drum shell segments 20*a*, 20*b*, 20*c*. For instance, drum shell 14 can include two drum shell segments 20*a*, 20*c* or more than three, such as four to ten different drum shell segments 20*a*, 20*b*, 20*c*, depending on the desired resulting sound characteristics. The drum shell segments 20*a*, 20*b*, 20*c* can have the same height or different heights. For example, one drum shell segment can have a first height and another drum shell segment can have a second height different from the first height such as taller or shorter than the first height. In an exemplary embodiment, drum shell 14 can include a plurality of drum shell segments 20*a*, 20*b*, 20*c* having various different heights.

Figure 4:
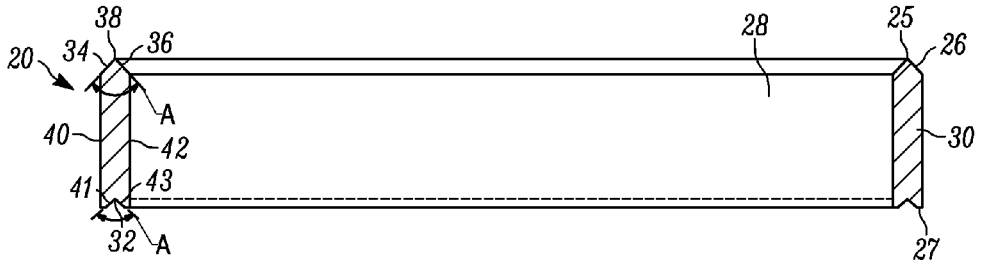
FIGS. 4-7 are a cross sectional views of exemplary drum shell segments according to exemplary embodiments of the present disclosure.

The drum shell segments 20*a*, 20*b*, 20*c* have a smooth outer surface and are configured to be removably coupled (e.g., interchangeable) between the first hoop 12 and the chassis support 16. For instance, as illustrated in FIG. 4, each drum shell segment 20 comprises a hollow cylindrical member 28 having a rim 30, a protrusion 26 formed in an upper surface 25 of the rim 30, and an annular groove 32 formed in a lower surface 27 of the rim 30 that opposes the upper surface 25, the function of which will be explained below. The drum shell segments 20*a*, 20*b*, 20*c* can be made of various materials including metal, wood, acrylic, synthetic, or a combination thereof. In an exemplary embodiment, each drum shell segment 20*a*, 20*b*, 20*c* is made of a metal such as steel or brass. In another exemplary embodiment, a single drum shell segment 20*a*, 20*b*, 20*c* can be made of a plurality of different materials such as metal and wood, a plurality of different types of synthetic material, etc.

The drum shell 14 can include drum shell segments 20*a*, 20*b*, 20*c* of a same material or the shells 20*a*, 20*b*, 20*c* can be made of a different material. For example, when a drum 10 including three drum shell segments 20*a*, 20*b*, 20*c* is used, all three drum shell segments 20*a*, 20*b*, 20*c* can be made of steel, all three drum shell segments 20*a*, 20*b*, 20*c* can be made of brass, or a combination of steel and brass drum shell segments 20*a*, 20*b*, 20*c* can be implemented where at least one drum shell segment 20*a*, 20*b*, 20*c* is made of steel and at least one drum shell segment 20*a*, 20*b*, 20*c* is made of brass. In an exemplary embodiment, each cylindrical member 28 can be manufactured using a metal rolling method where the resulting cylindrical member 28. However, one of ordinary skill in the art would recognize that each drum shell segment 20*a*, 20*b*, 20*c* can be manufactured using any known method such as casting, etc. In an exemplary embodiment, the drum shell segments 20*a*, 20*b*, 20*c* can have a thickness in the range of 3 mm-22 mm however one of ordinary skill in the art would recognize that the drum shell segments 20*a*, 20*b*, 20*c* can have any thickness.

Figure 5:
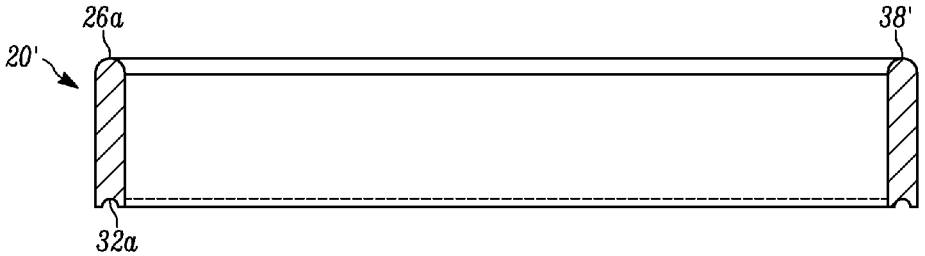
Figure 6:
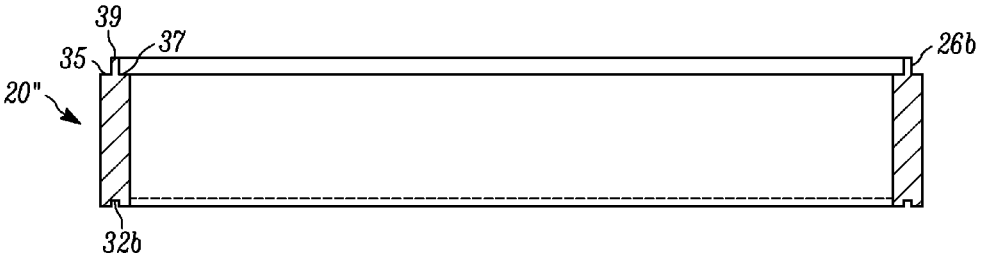
Figure 7:
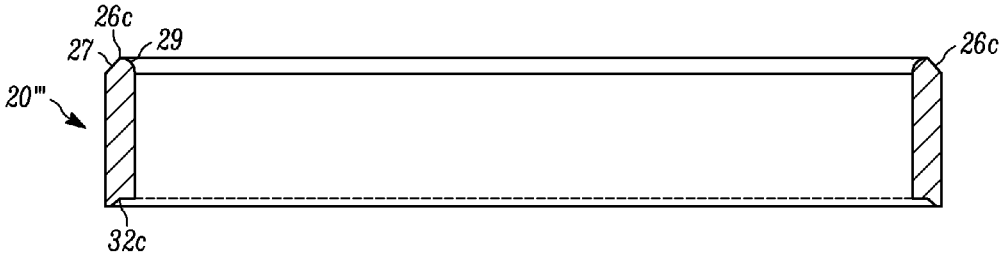

As best illustrated in FIG. 4, the protrusion 26 formed in the upper surface of the rim 30 of the drum shell segment 20 can include a first angled surface 34 and a second angled surface 36 where the first angled surface 34 and the second angled surface 36 meet in an apex 38 and define an angle A of preferably about 60°. In an exemplary embodiment, the apex 38 is disposed centrally between an outer surface 40 of the cylindrical member 28 and an inner surface 42 of the cylindrical member 28. However, the apex 38 can be alternatively offset. The protrusion 26 is preferably a single, annular protrusion continuous along the upper surface of the rim 30 of the cylindrical member 28. Alternatively, a plurality of spaced protrusions 26 can be disposed on the upper surface of the rim 30. While the protrusion 26 illustrated in FIG. 4 has angular walls 34, 36 meeting at an apex 38, one of ordinary skill in the art would recognize that the protrusion 26 can have any shape. For example, as illustrated in FIG. 5, the walls of the annular protrusion 26*a* of shell 20' can define a rounded apex 38', or, as illustrated in FIG. 6, the annular protrusion 26*b* of shell 20" can have opposing planar surfaces 35 and 37 joined by planar surface 39, or, as illustrated in FIG. 7, the protrusion 26*c* of shell 20''' can have an angled surface 27 and a rounded surface 29.

Returning to FIG. 4, an annular groove 32 is formed in a lower surface of the rim 30 of each drum shell segment 20. The annular groove 32 is configured to engage a protrusion 26 of an adjacent, drum shell segment 20, e.g. shell 20*b* of FIG. 2. The annular groove 32 can have a depth such that only a portion of the protrusion 26 engages the annular groove 32 or the annular groove 32 can have a depth to fully engage with the protrusion 26. In an exemplary embodiment, the annular groove 32 is defined by surfaces 41 and 43 defining an angle A of about 60° there-between so as to mate with the protrusion 26 of the adjacent shell, e.g., shell 20*b* of FIG. 2. In the embodiment of FIG. 4, the annular groove 32 is disposed centrally between the outer surface 40 of the cylindrical member 28 and the inner surface 42 of the cylindrical member 28. However, one of ordinary skill in the art would recognize that the groove 32 and the corresponding protrusion 26 can be offset. While one annular groove is illustrated in FIG. 4, one of ordinary skill in the art would recognize that the number of grooves 32 is related to the number of protrusions 26; thus if a plurality of spaced protrusions is implemented, a corresponding number of spaced grooves would be formed in the lower surface of the cylindrical member 28 or a single annular groove 32 can receive the spaced protrusions.

While the groove 32 illustrated in FIG. 4 has angular walls 41, 43 meeting at an apex, one of ordinary skill in the art would recognize that the groove 32 can have any shape. For example, as illustrated in FIG. 5, when the protrusion 26*a* includes a curved surface, the groove 32*a* can be of a shape so as to receive a protrusion of an adjacent shell 20'. FIG. 6 shows the groove 32*b* having a shape so as to receive a protrusion 26*b* of an adjacent shell 20" and FIG. 7 shows groove 32*c* having a shape to receive the protrusion 26*c* of an adjacent shell 20''', when the shells are stacked.

The chassis support 16 is configured to support the drum shell 14. For example, an annular surface 44 of chassis support 16 that contacts the drum shell 14 can be planar or can include a protrusion (not illustrated) that corresponds with the annular groove 32 of the drum shell segment 20*c* mounted adjacent to the chassis support 16. The chassis support 16 includes a ring member 45 that defines surface 44 and that includes a plurality of flanges 46 extending from an outer surface thereof.

Each tensioning device 18 is configured to secure the drum shell segments 20*a*, 20*b*, 20*c* between the first hoop 12 and the chassis support 16. When drum 10 includes a second hoop 13, each tensioning device 18 is further configured to secure the second hoop 13 to the chassis support 16. With reference to FIG. 2, in an exemplary embodiment, each tensioning device 18 includes a lug 70, preferably in the form of a post, and tension rods 72, 74. However, any other type of tensioning device can be implemented. Each lug 70 is coupled to a corresponding flange 46 of the chassis support 16. For example, each lug 70 can be permanently coupled to the flange 46 or removably coupled to the flange 46. Tension rods 72, 74 include a threaded shaft 75 where tension rod 72 passes through flange 24 to engage with internal threads of a lug 70 and tension rod 74 passes through flanges 46 and 66 to threadedly engage with the corresponding threads in the lug 70. In an exemplary embodiment, a washer 76 is disposed between the tension rod 72, 74 and the flange 24, 66, respectively.

One of ordinary skill in the art would recognize that no hardware is coupled to a drum shell 14 to secure the drum shell, thus allowing the drum shell 14 to be arranged freely while resting on the surface 44 of the chassis support 16. This is due to each tensioning device 18 being coupled only to the first hoop 12, the chassis support 16, and the second hoop 13, where applicable. Each tensioning device 18 is spaced away from the drum shell 14 to reduce the amount of influence the tensioning devices 18 have on the resulting sound characteristics created within the drum shell 14 of the drum 10.

In operation, as best illustrated in FIGS. 1 and 2, a first drum shell segment 20*a* is provided on the upper surface 44 of the chassis support 16. A second drum shell segment 20*b* is placed on top of the first drum shell segment 20*a* in axially stacked relation such that the protrusion 26 of the first drum shell segment 20*a* engages with the annular groove 32 of the second drum shell segment 20*b*. A third drum shell segment 20*c* is then placed on top of the second drum shell segment 20*b* such that the protrusion 26 of the second drum shell segment 20*b* engages with the annular groove 32 of the third drum shell segment 20*c*. The first hoop 12 is then provided over the third drum shell segment 20*c* where a drum skin 52 is secured between the first hoop 12 and the third drum shell segment 20*c*. The plurality of tensioning devices 18 can then be secured between the first hoop 12 and the chassis support 16 where tension rods 72 pass through flange 24 and threadedly engage with an associated lug 70. Tightening the tension rods 72 into the lugs 70 stretches the drum skin 52 over a the third drum shell segment 20*c* applying downward force to the protrusion 26 (FIG. 3) of third shell segment 20*c* respectively forcing the annular groove 32 and protrusion 26 of all shell segments 20*a*, 20*b*, 20*c* to lock together and be held in place between chassis support 16 and first hoop 12. When a second hoop 13 is added to drum 10, tension rods 74 pass through flange 66 of the second hoop 13 and flange 46 of the chassis support 16 to threadedly engage with the lugs 70.

As noted above, the first drum shell segment 20*a*, the second drum shell segment 20*b*, and the third drum shell segment 20*c* can be made of the same or different materials. In a first exemplary embodiment, the first drum shell segment 20*a* and the third drum shell segment 20*c* can be made of brass and the second drum shell segment 20*b* can be made of steel. In a second exemplary embodiment, the first drum shell segment 20*a* can be made of steel and the second drum shell segment 20*b* and the third drum shell segment 20*c* can be made of brass. In a third exemplary embodiment, the first drum shell segment 20*a* and the second drum shell segment 20*b* can be made of brass and the third drum shell segment 20*c* can be made of steel. Other combinations of the drum shell segments are possible.

Figure 8:
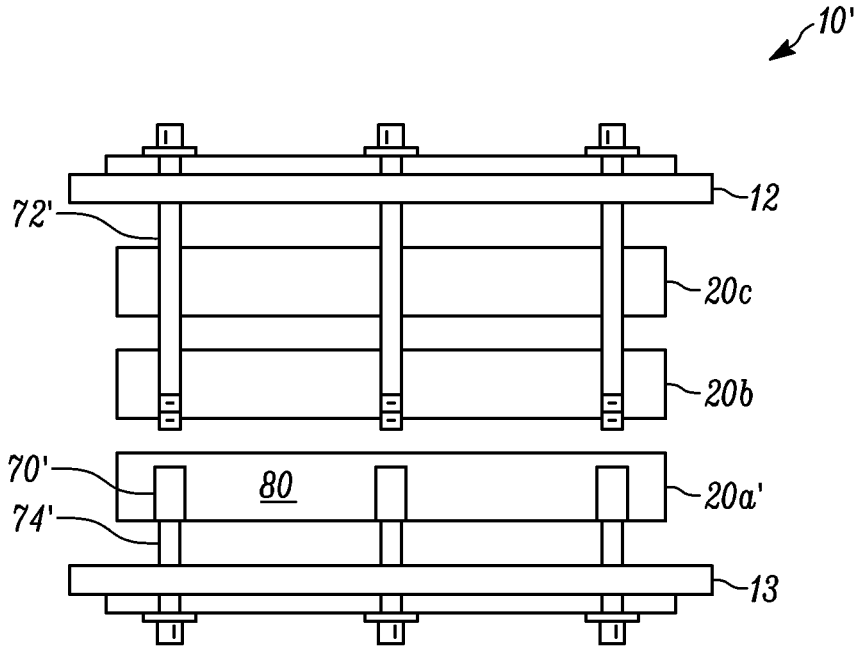
FIG. 8 is a side elevational view of a drum according to a second exemplary embodiment of the present disclosure.

FIG. 8 shows another embodiment of the drum 10'. Unlike the free-floating shell 14 of FIGS. 1 and 2 wherein the tensioning structure includes a chassis 16 carrying lugs 70, the tensioning structure of FIG. 8 includes a plurality of internally threaded lugs 70' coupled directly to the outer peripheral surface 80 of at least one of the shell segments. In the embodiment, the lugs 70 are coupled to the bottom shell segment 20*a'* of drum 10'. The tension rods 72' extend through first hoop 12 and threadedly engage with an associated lug 70'. In a manner similar to that of the embodiment of FIG. 1, but without requiring the chassis 16, tightening the tension rods 72' into the lugs 70' stretches the drum skin 52 over a the third drum shell segment 20*c* applying downward force to the protrusion 26 of third shell segment 20*c* respectively. This forces the annular groove 32 and protrusion 26 of all shell segments 20*a'*, 20*b*, 20*c* to lock together and be held in place between the shell segment 20*a'* and the first hoop 12. Thus, the second shell segment 20*b* and the third shell segment 20*c* are clamped by the tensioning structure between the first hoop 12 and the first shell segment 20*a'*.

When a second hoop 13 is added to drum 10', tension rods 74' pass through the second hoop 13 to threadedly engage with the lugs 70' no matter on which shell segment the lugs 70 are located. For example, instead of providing the lugs 70 on the bottom shell segment 20*a'*, the lugs 70 can be coupled to shell segment 20*c* or 20*b*. When the second hoop 13 is provided to clamp the shell segments to the first hoop 12, the lugs 70 can be coupled to only one of the shell segments, regardless of the number of shell segments that are provided to form the drum shell 14.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A drum comprising:

a drum shell comprising a first drum shell segment and at least a separate, second drum shell segment, wherein the first drum shell segment and the second drum shell segment each comprises a hollow cylindrical member having a rim, a protrusion formed in an upper surface of the rim, and an annular groove formed in a lower surface of the rim that opposes the upper surface, the protrusion of one of the drum shell segments being received in the groove of the other of the drum shell segments so that the first and second drum shell segments are disposed in axially stacked relation, a first hoop mounting a first drum skin to the drum shell, and tensioning structure constructed and arranged to removably secure the drum shell to the first hoop.

2. The drum of claim 1, wherein the tensioning structure comprises:

a chassis support having an upper surface engaging the lower surface of one of the drum shell segments so as to support the drum shell, and a plurality of tensioning devices coupled between the first hoop and the chassis support, wherein the tensioning devices are configured to removably secure the first drum shell segment and the second drum shell segment between the first hoop and the chassis support absent any hardware on the drum shell.

3. The drum of claim 1, wherein the tensioning structure comprises:

a plurality of lugs on a periphery surface of at least one of the shell segments, and a plurality of tensioning devices coupled between the first hoop and lugs so as to secure the drum shell to the first hoop.

4. The drum of claim 1, wherein the protrusion of first drum shell segment is received in the groove of the second drum shell segment, the protrusion of the second drum shell segment engages a portion of the first drum skin, and the upper surface of the chassis support engages the lower surface of first drum shell segment, and wherein each drum shell segment has the same outer diameter.

5. The drum of claim 1, wherein each protrusion is annular and has surfaces that define and angle of about 60°.

6. The drum of claim 1, wherein the first hoop comprises:

a first flange extending from an outer surface of the first hoop, wherein a portion of the tensioning structure is removably coupled to the first flange; and a first drum skin receiving structure formed on an inner surface of the first hoop, wherein the first drum skin receiving structure is configured to receive a peripheral end of the first drum skin.

7. The drum of claim 2, further comprising:

a second hoop mounting a second drum skin to the drum, wherein the second hoop is mounted to the chassis support.

8. The drum of claim 3, further comprising:

a second hoop mounting a second drum skin to the drum, wherein the second hoop is mounted to the lugs by additional tensioning devices.

9. The drum of claim 7, wherein the second hoop comprises:

a second flange extending from an outer surface of the second hoop, wherein the tensioning devices are removably coupled to the first flange of the first hoop, the second flange of the second hoop, and the chassis support; and a second drum skin receiving structure formed on an inner surface of the second hoop, wherein the second drum skin receiving portion is configured to receive the second drum skin.

10. The drum of claim 2, wherein the chassis support comprises:

a third flange extending from an outer surface of the chassis support, wherein the tension devices are removably coupled between the first flange and the third flange.

11. The drum of claim 10, wherein the upper surface of the chassis support includes a protrusion engaged with the annular groove of the drum shell segment engaged therewith.

12. The drum of claim 2, wherein each tensioning device comprises:

a lug coupled to the chassis support; and a first tension rod coupled between the first flange of the first hoop and the lug, wherein each tensioning device is directly coupled between the first hoop and the chassis support such that the lug is spaced away from the drum shell.

13. The drum of claim 12, further comprising:

a second hoop mounting a second drum skin to the drum, wherein the second hoop is mounted to the chassis support, the second hoop having a second flange extending from an outer surface of the second hoop, wherein each tensioning device further comprises a second tension rod coupled between the second flange of the second hoop and the lug.

14. The drum of claim 1, wherein the first drum shell segment comprises a first material and the second drum shell segment comprises a second material different from the first material.

15. The drum of claim 1, wherein the first drum shell segment and the second drum shell segment are made of the same material.

16. The drum of claim 1, wherein each protrusion is annular and includes an apex disposed generally centrally between an outer surface and an inner surface of each of the first drum shell segment and the second drum shell segment, and each groove is constructed and arranged to receive at least a portion of an associated apex.

17. The drum of claim 16, wherein the apex includes a rounded surface.

18. The drum of claim 1, wherein the drum shell further comprises a third shell segment in stacked relation with the first and second shell segments.

19. The drum of claim 18, wherein at least the first and third drum shell segments are made of a first material and the second drum shell segment is made of a second material different from the first material.

20. The drum of claim 18, wherein the first drum shell segment, the second drum shell segment, and the third drum shell segment are made of the same material.

21. A drum shell comprising at least a first drum shell segment comprising a hollow cylindrical member having a rim, a protrusion formed in an upper surface of the rim, and an annular groove formed in a lower surface of the rim that opposes the upper surface.

22. The drum shell of claim 21, further comprising a second drum shell segment, separate from the first drum shell segment, wherein the second drum shell segment comprises a second hollow cylindrical member having a second rim, a second protrusion formed in an upper surface of the second rim, and a second annular groove formed in a lower surface of the second rim that opposes the upper surface, such that the first and second drum shell segments can be disposed in axially stacked relation defining the drum shell when the protrusion of the first drum shell segment is received in the groove of the second drum shell segment.

23. The drum shell of claim 22, wherein the first drum shell segment comprises a first material and the second drum shell segment comprises a second material different from the first material.

24. The drum shell of claim 22, wherein each protrusion is annular.

25. The drum shell of claim 22, wherein at least one of the shell segments includes a plurality of internally threaded lugs coupled to a peripheral surface thereof.

* * * * *